US006084612A

United States Patent [19]

Suzuki et al.

[11] Patent Number: 6,084,612

[45] Date of Patent: Jul. 4, 2000

[54] LIQUID EJECTION HEAD, LIQUID EJECTION HEAD CARTRIDGE, PRINTING APPARATUS, PRINTING SYSTEM AND FABRICATION PROCESS OF LIQUID EJECTION HEAD

[75] Inventors: Takumi Suzuki; Hirokazu Komuro, both of Yokohama, Japan

[73] Assignee: Canon Kabushiki Kaisha, Tokyo, Japan

[21] Appl. No.: 08/900,290

[22] Filed: Jul. 25, 1997

[30] Foreign Application Priority Data

Jul. 31, 1996 [JP] Japan ..... 8-201362
Jul. 31, 1996 [JP] Japan ..... 8-202223

[51] Int. Cl.[7] ..... B41J 2/14

[52] U.S. Cl. ..... 347/50; 347/58

[58] Field of Search ..... 347/50, 58, 59

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,723,129 | 2/1988 | Endo et al. | 346/1.1 |
| 4,740,796 | 4/1988 | Endo et al. | 346/1.1 |
| 4,860,033 | 8/1989 | Shiozaki et al. | 346/140 R |
| 4,873,622 | 10/1989 | Komuro et al. | 346/140 R |
| 4,881,318 | 11/1989 | Komuro et al. | 29/827 |
| 5,322,811 | 6/1994 | Komuro et al. | 437/51 |
| 5,347,713 | 9/1994 | Shibata et al. | 29/890.1 |
| 5,479,197 | 12/1995 | Fujikawa et al. | 347/63 |
| 5,485,185 | 1/1996 | Sueoka et al. | 347/64 |
| 5,491,505 | 2/1996 | Suzuki et al. | 347/203 |
| 5,580,468 | 12/1996 | Fujikawa et al. | 216/27 |
| 5,649,359 | 7/1997 | Murakami et al. | 29/890.1 |
| 5,696,544 | 12/1997 | Komuro | 347/50 |
| 5,847,729 | 12/1998 | Takahashi et al. | 347/43 |

FOREIGN PATENT DOCUMENTS

| | | |
|---|---|---|
| 0 624 472 | 11/1994 | European Pat. Off. . |
| 59-123670 | 7/1984 | Japan . |
| 59-138461 | 8/1984 | Japan . |
| 4-175728 | 6/1992 | Japan . |

*Primary Examiner*—John Barlow
*Assistant Examiner*—Michael S. Brooke
*Attorney, Agent, or Firm*—Fitzpatrick, Cella, Harper & Scinto

[57] ABSTRACT

A liquid ejection head includes a head chip having a plurality of ejection openings, ejection energy generating means for ejecting a liquid from the ejection openings, and a liquid chamber communicated with the ejection openings and being supplied a liquid, an electrical wiring substrate formed with a chip installation hole arranged wherein the head chip, a plurality of lead terminals projecting into the chip installation hole of the electrical wiring substrate and being connected to the head chip for supplying electric power to the ejection energy generating means, and a sealing material layer sealing connecting portion between the lead terminals and the head chip and formed over the electrical wiring substrate and the head chip, and a resin catching portion being provided in a gap between the chip installation hole and the head chip for receiving the seal resin for achieving high strength of the connecting portion between the head chip and the electric wiring substrate, and to achieve good seal.

35 Claims, 17 Drawing Sheets

LIQUID EJECTION HEAD, LIQUID EJECTION HEAD CARTRIDGE, PRINTING APPARATUS, PRINTING SYSTEM AND FABRICATION PROCESS OF LIQUID EJECTION HEAD

BACKGROUND OF THE INVENTION

1. Field of the Invention

The present invention relates to a liquid ejection head, a liquid ejection head cartridge incorporating the liquid ejection head, a printing apparatus employing the liquid ejection head cartridge, a printing system employing the printing apparatus, and a fabrication process of the liquid ejection head.

2. Description of the Related Art

A printing apparatus, such as an ink-jet printer, has a liquid ejection head, i.e. an ink-jet head including an ejection energy generating means for heating a liquid in a liquid passage and whereby ejecting the liquid from an ejection opening. The ink-jet head is a major portion constructed with a head chip having a liquid chamber, to which the liquid is supplied, and an electric wiring substrate, to which the head chip is connected. In the head chip, an electrical wiring for applying an electrical pulse to an electrothermal transducer as the ejection energy generating means for heating the liquid in each liquid passage, is built-in. In order to minimize the electrical wiring on the ink-jet head side, there has been known the head chip, in which an IC is built-in, or in which wiring corresponded to the electrothermal transducer are provided in one-by-one basis and an IC is mounted on the electrical wiring substrate side.

When the head chip of the ink-jet head and the electrical wiring substrate are assembled, it has been typically employed, in the prior art, to connect the head chip to a print circuit board as the electric wiring substrate by wire bonding, or to fit a predetermined mating surface of the head chip onto a flexible print circuit board as the electric wiring substrate under pressure.

However, in mass production of the ink-jet head, these method form the individual ink-jet heads in the connected condition, to require substantial work load, such as transportation or the like, in the subsequent process, and requires a large number of sets of various devices to require substantial investment for facilities. When the individual ink-jet head has relatively large number of wiring, it becomes necessary to provide large area for the connecting portion of lead terminals, namely to provide large dimension of the head chip in the width direction to cause high parts cost.

From the point of view, TAB (tape automated bonding) system, in which chip installation holes are intermittently formed through the electric wiring substrate integrated with a carrier film, and the head chips are placed on the chip installation holes to connect therebetween, has become widespread.

A configuration in plan view of the ink-jet head produced by the TAB system is illustrated in FIG. 15, and a section taken along line XVI—XVI is shown in FIG. 16, and a configuration in plan view of the condition where the head chip and the electric wiring substrate are connected but a seal resin is not yet applied, is illustrated in FIG. 17. At a center portion of an electrically insulative film form electric wiring substrate 11, a chip installation hole 13 having the same corresponding to an outer contour of a head chip 12 is formed. A plurality of lead terminals 14 having tip ends to be fitted on the head chip 12 are projected from the inner periphery of the chip installation hole 11. With these tip ends of the lead terminals 14, not shown connection electrodes exposed on the surface of the head chip 12 are mated with each other for establishing electrical connection therebetween. A seal resin 16 is applied over the chip head 12 and the electrical wiring substrate 11 so as to seal the connecting portion.

In the ink-jet head, ejection openings 15 for the liquid are arranged at the center portion of the head chip 12. Therefore, the seal resin 16 has to be applied without blocking these ejection openings 15.

When the ink-jet head shown in FIGS. 15 and 16 is produced by the TAB system, the seal resin 16 cannot be applied for the portion where the lead terminals 14 are not projected from the inner periphery of the chip installation hole 13. If attempt is made to apply the seal resin 16 between the head chip 12 and the chip installation hole 13 over the entire circumference of the head chip 12, the seal resin 16 should penetrate into the back side of the electric wiring substrate 11 through a gap portion S where the lead terminal 14 is not present to make it impossible to maintain the ink-jet head in normal configuration. Furthermore, since there is a portion where the seal resin 16 cannot be placed between the electric wiring substrate 11 and the head chip 12, sufficiently high strength in connection cannot be provided.

Thus, since the gap S where the seal resin 16 is not interposed between the head chip 12 and the chip installation hole 13, when another resin is injected around the head chip 12 after formation of seal by the seal resin 16 of the connecting portion between the connection electrodes and the lead terminal 14, the resin should form meniscus should be formed at the end of the gap portion S to prevent the resin from being injected smoothly. This causes a part of the liquid ejected from the ejection opening 15 to penetrate into the end portion of the gap portion S to cause corrosion on the TAB lead for forming electrical wiring of the head chip 12 to cause failure, such as breakage of the circuit and the like.

It may be considered to make the width of the gap portion S smaller. However, in view of the current status of technology of processing of the chip installation hole 13, processing with quite high precision in the extent to significantly restrict getting around of the seal resin 16.

SUMMARY OF THE INVENTION

It is the first object of the present invention to provide a liquid ejection head which has high strength at a connecting portion between a head chip and an electrical wiring substrate, and can provide high sealing ability.

The second object of the present invention is to provide a liquid ejection head cartridge employing the liquid ejection head.

The third object of the present invention is to provide a printing apparatus, in which the liquid ejection head having high strength at a connecting portion between a head chip and an electrical wiring substrate, and can provide high sealing ability, is employed.

The fourth object of the present invention is to provide a printing system employing the printing apparatus.

The fifth object of the present invention is to provide a fabrication process of the liquid ejection head.

According to the first aspect of the invention, there is provided a liquid ejection head comprising:

a head chip having a plurality of ejection openings, ejection energy generating means for ejecting a liquid from the ejection openings, and a liquid chamber communicated with the ejection openings and being supplied a liquid;

an electrical wiring substrate formed with a chip installation hole arranged wherein the head chip;

a plurality of lead terminals projecting into the chip installation hole of the electrical wiring substrate and being connected to the head chip for supplying electric power to the ejection energy generating means;

a sealing material layer sealing connecting portion between the lead terminals and the head chip and formed over the electrical wiring substrate and the head chip; and a gap between the chip installation hole and the head chip form a resin catching portion for catching the sealing material.

In the first aspect of the liquid ejection head according to the present invention, the ejection opening may be arranged in opposition to the ejection energy generating means. The ejection energy generating means may be an electrothermal transducer having a heating resistor generating a heat when an electric signal is applied.

According to the second aspect of the present invention, there is provided a liquid ejection head cartridge including a liquid ejection head and a liquid tank storing a liquid for supplying to the liquid ejection head, comprising:

the liquid ejection head including a head chip having a plurality of ejection openings, ejection energy generating means for ejecting a liquid from the ejection openings, and a liquid chamber communicated with the ejection openings and being supplied a liquid, an electrical wiring substrate formed with a chip installation hole arranged wherein the head chip, a plurality of lead terminals projecting into the chip installation hole of the electrical wiring substrate and being connected to the head chip for supplying electric power to the ejection energy generating means, and a sealing material layer sealing connecting portion between the lead terminals and the head chip and formed over the electrical wiring substrate and the head chip; and a resin catching portion being provided in a gap between the chip installation hole and the head chip for receiving the sealing material.

In the second aspect of the liquid ejection head cartridge according to the present invention, the liquid may be an ink and/or a treatment liquid for adjusting property of the ink ejected to the printing medium. The ejection opening may be arranged in opposition to the ejection energy generating means.

According to the third aspect of the present invention, there is provided a printing apparatus comprising:

a mounting portion of a liquid ejection head including a head chip having a plurality of ejection openings, ejection energy generating means for ejecting a liquid from the ejection openings, and a liquid chamber communicated with the ejection openings and being supplied a liquid, an electrical wiring substrate formed with a chip installation hole arranged wherein the head chip, a plurality of lead terminals projecting into the chip installation hole of the electrical wiring substrate and being connected to the head chip for supplying electric power to the ejection energy generating means, and a sealing material layer sealing connecting portion between the lead terminals and the head chip and formed over the electrical wiring substrate and the head chip; and a resin catching portion being provided in a gap between the chip installation hole and the head chip for receiving the sealing material.

In the third aspect of the printing apparatus according to the present invention, the liquid may be an ink and/or a treatment liquid for adjusting property of the ink ejected to the printing medium. The mounting portion of the liquid ejection head may be a carriage movable for scanning in a direction perpendicular to a transporting direction of the printing medium which a liquid droplet is ejected from the liquid ejection head. In this case, the liquid ejection head may be detachable to the carriage. Alternatively, the ejection openings of the liquid ejection head may be arranged over the entire width of the printing region of the printing medium. Printing may be performed as taking paper, cloth, plastic, metal, wood or leather as the printing medium. A plurality of colors of liquids may be ejected from the liquid ejection head to perform color printing by depositing a plurality of colors of liquids in the printing medium.

According to the fourth aspect of the present invention, there is provided a printing system including a control portion for processing an input image information and output means for outputting information processed by the control portion, wherein the output means comprising a printing apparatus as recited in third aspect of the printing apparatus. Namely, the printing system according to the present invention is used the printing apparatus as output means of the information processing system, such as a copy machine, a facsimile, an electronic typewriter, a wordprocessor, a printer as an output terminal of a work station, or as a handy or portable printer to be included in a personal computer, a host computer, an optical disk device, a video device and so on.

According to the fifth aspect of the invention, there is provided a fabrication process of a liquid ejection head comprising:

step of positioning a head chip having a plurality of ejection openings, ejection energy generating means for respectively ejecting a liquid through the ejection openings, and a liquid chamber communicated with the ejection openings and being supplied the liquid, in a chip installation hole formed in an electrical wiring substrate;

step of connecting a plurality of lead terminals projecting into the chip installation hole of the electrical wiring substrate from the inner periphery thereof for supplying electrical power to the ejection energy generating means;

step of applying a seal resin over the electrical wiring substrate and the head chip for sealing a connecting portion between the lead terminals and the head chip; and step of forming a resin catching portion for catching the seal resin within a gap portion between the chip installation hole and the head chip.

In the first to fifth aspects of the present invention, the resin catching portion may be a dummy lead terminal formed on the electric wiring substrate. Alternatively, the resin catching portion may be formed by setting the width of the chip installation hole along the aligning direction of the plurality of lead terminals in the connecting portion, to be narrower than other portion. The sealing material may be constructed by a solventless epoxy resin.

The width of the gap between the resin catching portion and the lead terminal closest to the resin catching portion, the width of the gap between the resin catching portion and the head chip, or a width of a gap between the resin catching portion and the inner periphery of the chip installation hole is greater than or equal to 0.05 mm and less than or equal to 0.5 mm, and preferably greater than or equal to 0.1 mm and less than or equal to 0.3 mm. The width of the chip installation hole along the aligning direction of the plurality of lead terminals other than the connecting portion may be greater than or equal to 0.7 mm and less than or equal to 2.0 mm, and more preferably to be greater than or equal to 0.8 mm and less than or equal to 1.5 mm.

According to the present invention, since the resin catching portion for receiving the sealing material layer is formed in the gap portion between the head chip and the chip installation hole, when the seal resin is applied to the gap portion between the head chip and the chip installation hole, the seal resin may not flow around the back surface of the electric wiring substrate to certainly seal the gap between the head chip and the chip installation hole.

Therefore, it becomes possible to certainly provide seal of the liquid ejection head to provide highly reliable liquid ejection head and the liquid ejection head cartridge. Furthermore, it is possible to enhance connection strength between the head chip and the electric wiring substrate. Particularly, when the seal material layer is formed over the entire periphery of the head chip, sealing ability and connection strength can be improved significantly in comparison with the prior art.

DESCRIPTION OF THE PREFERRED EMBODIMENT

A liquid ejection head according to the present invention will be explained in detail with reference to FIGS. 1 to 5 in terms of a side-shooting type, namely one embodiment applied for an ink-jet head, in which an ejection opening of a liquid is arranged in opposition to an ejection energy generating means. The present invention is applicable not only for the side-shooting type ink-jet head but also for an edge-shooting type or a type, in which the ejection opening of the liquid is arranged on the side portion of the ejection energy generating means.

Figure 1:
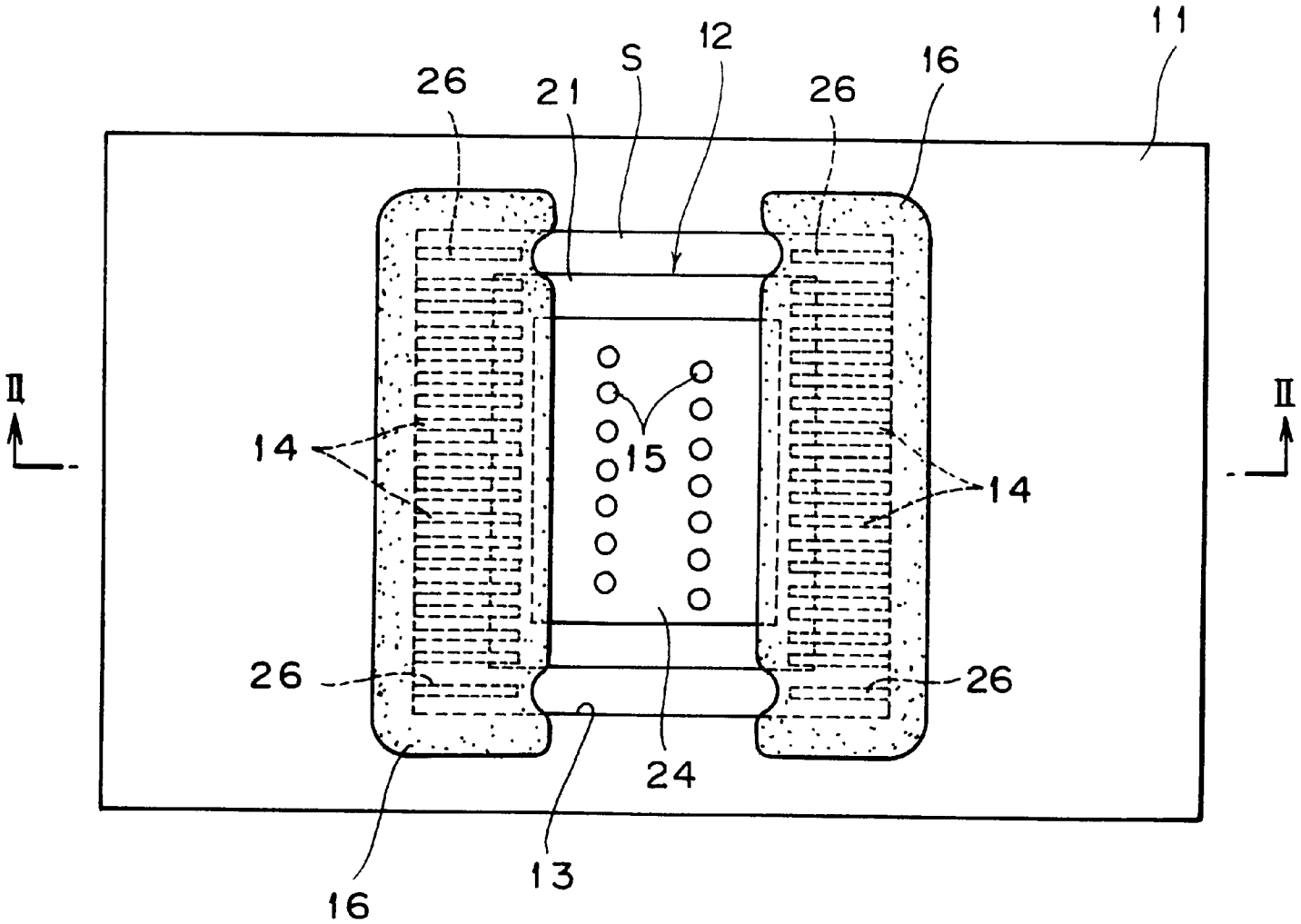
FIG. 1 is a plan view of one embodiment of an ink-jet head according to the present invention.
Figure 2:
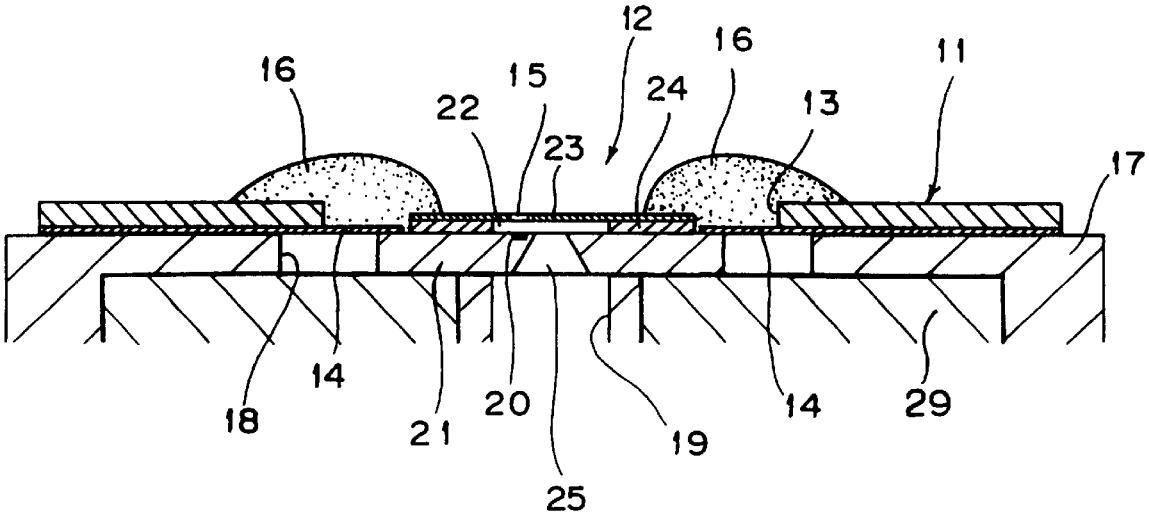
FIG. 2 is a section taken along line II—II of FIG. 1.
Figure 3:
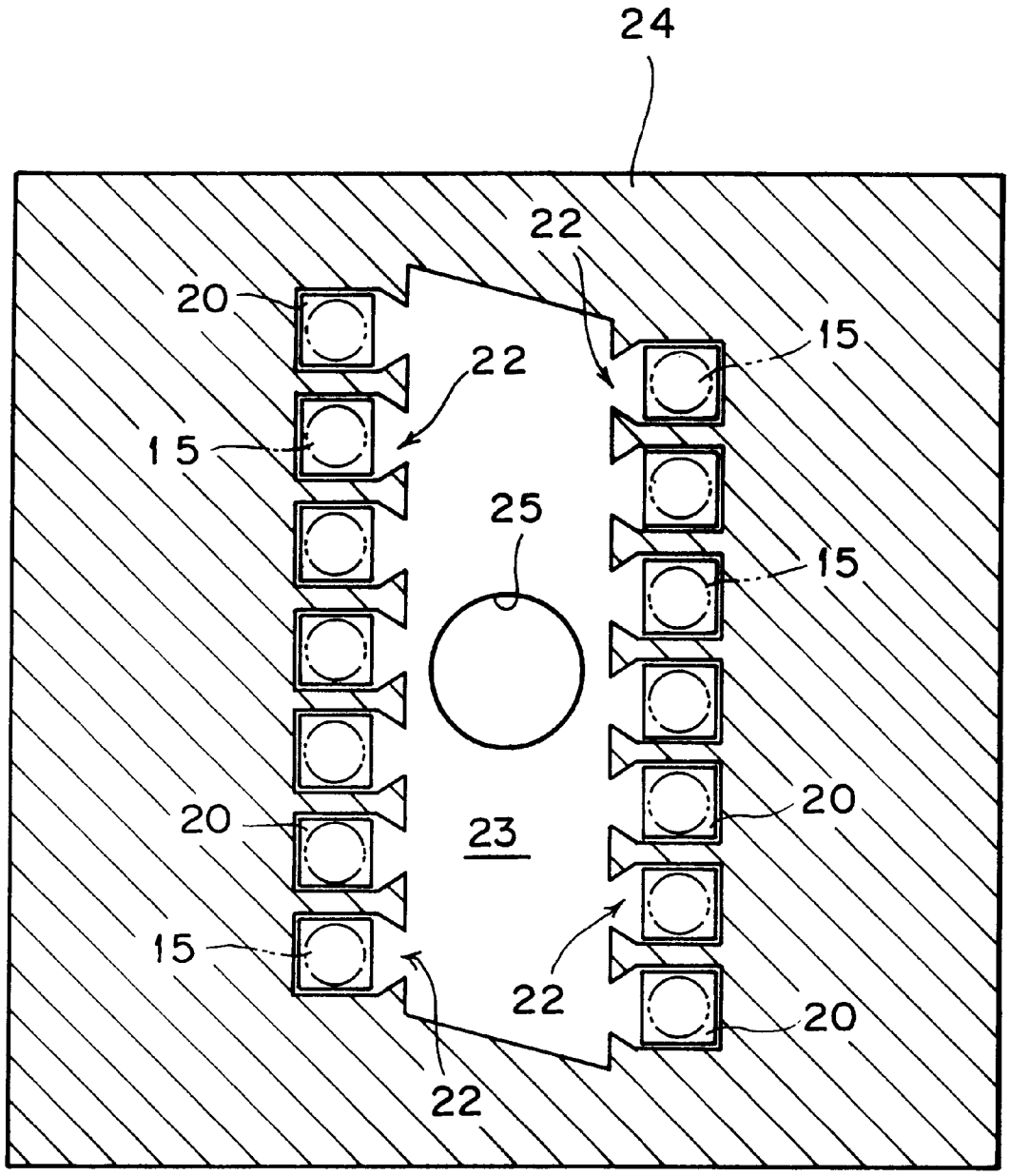
FIG. 3 is a section showing the internal structure of the ink-jet head showing in FIGS. 1 and 2.

As shown in FIG. 1 which illustrates the configuration in front elevation of one embodiment of an ink-jet head, FIG. 2 which illustrates a section taken along line II—II, and FIG. 3 which illustrates the internal structure of a head chip, on the center portion of a mold member 17 mounted on an electric wiring substrate 11, a cross-sectionally quadrangular recess portion 18 exposing a part of the upper end surface of an L-shaped support member 29 integrally formed with the mold member 17, is formed. To the recessed portion 18, a liquid supply passage 19 connected to a not shown supply source of a liquid, such as an ink at one end, is opened at the other end thereof. In the recessed portion 18, a head chip 12 is disposed and integrated by bonding by a not shown adhesive.

The head chip 12 is constructed the major portion thereof with an ejection element substrate 21, on which electrothermal transducers 20 as ejection energy generating means are arranged at a predetermined interval, a grooved plate 24 overlappingly mated with the ejection element substrate 21 for defining liquid passages 22 separating respective electrothermal transducers 20 and a common liquid chamber 23 communicated with the liquid passages 22. On the center portion of the ejection element substrate 21, a communication passage 25 for establishing communication between the common liquid chamber 23 and the liquid supply passage 19 is formed. Not shown electrode terminals connected to respective electrothermal transducers 20 are lead on the surface of the ejection element substrate 21. In the grooved plate 24, ejection openings 15 respectively opposing to the electrothermal transducers 20 are formed.

Accordingly, by applying a pulse form current to the electrothermal transducers 20, the liquid in the liquid passage 22 surrounding the electrothermal transducer 20 is instantly boiled for ejecting a liquid droplet through the ejection opening 15 by the boiling pressure.

On the center portion of the electric wiring substrate 11, a chip installation hole 13 surrounding a head chip 12 is formed. On the electric wiring substrate 11, a plurality of lead terminals 14 to be mated with electrode terminals of the head chip 12, are formed in the condition where tip ends of the lead terminals 14 are extended from the inner periphery of the chip end installation hole 13. By way of ILB (Inner Lead Bonding) method, these lead terminals 14 are electrically connected to the electrode terminals of the head chip 12. A TAB connection portion between the electrode terminals and the lead terminals 14 is covered with a seal resin 16. The seal resin 16 is formed over the head chip 12 and the electrical wiring substrate 11. In the shown embodiment, a thickness of the seal resin 16 is 0.5 mm.

In the shown embodiment, upper and lower sides of the lead terminals 14 located at the upper and lower end portions, dummy terminals 26 extending into a gap S defined between head chip 12 and the inner periphery of the chip installation hole 13 are arranged to retain the seal resin 16 together with the lead terminals 14.

Figure 4:
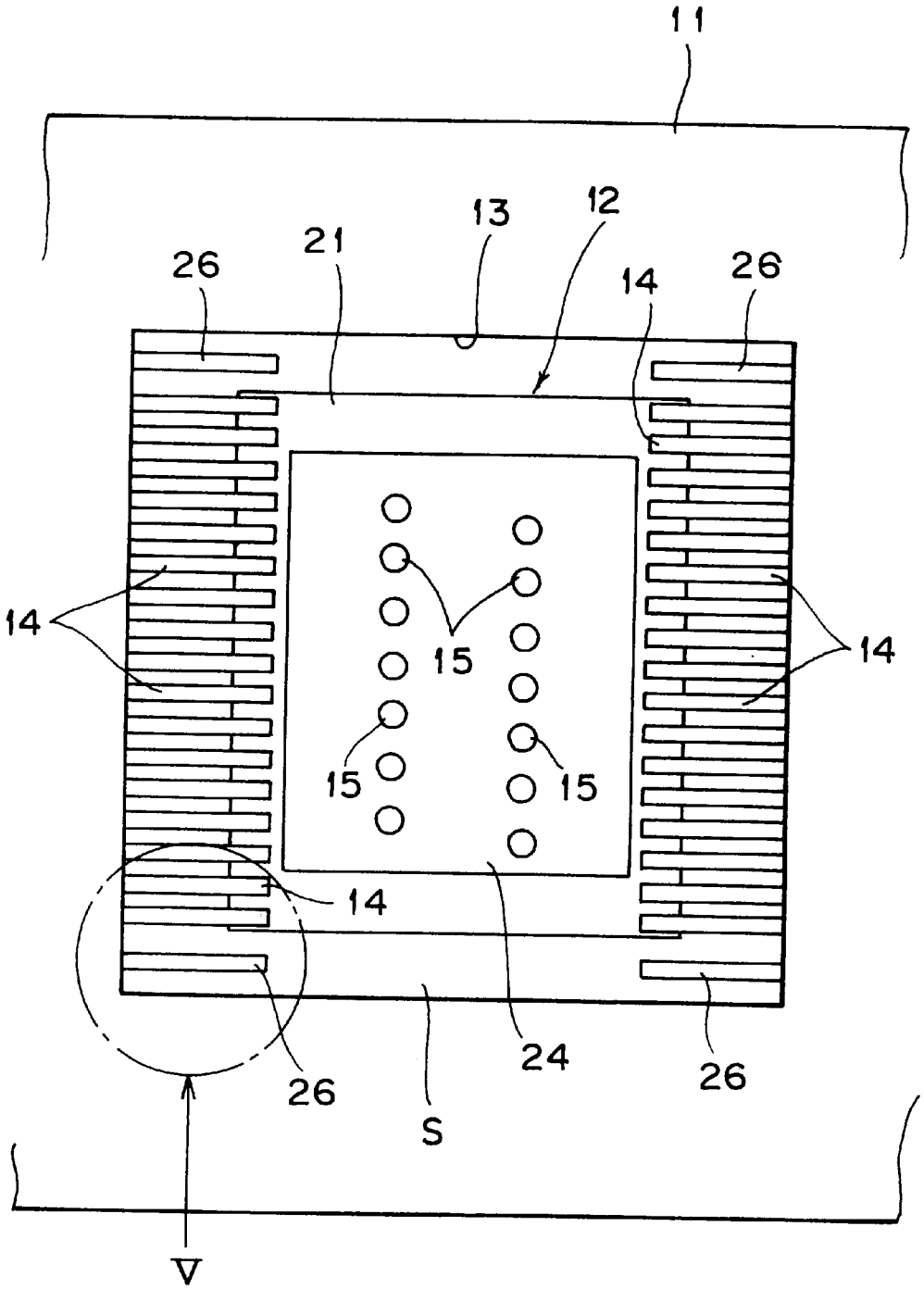
FIG. 4 is a plan view showing a condition on the way of fabrication process of the ink-jet head of the present invention shown in FIGS. 1 to 3, before application of a seal resin.
Figure 5:
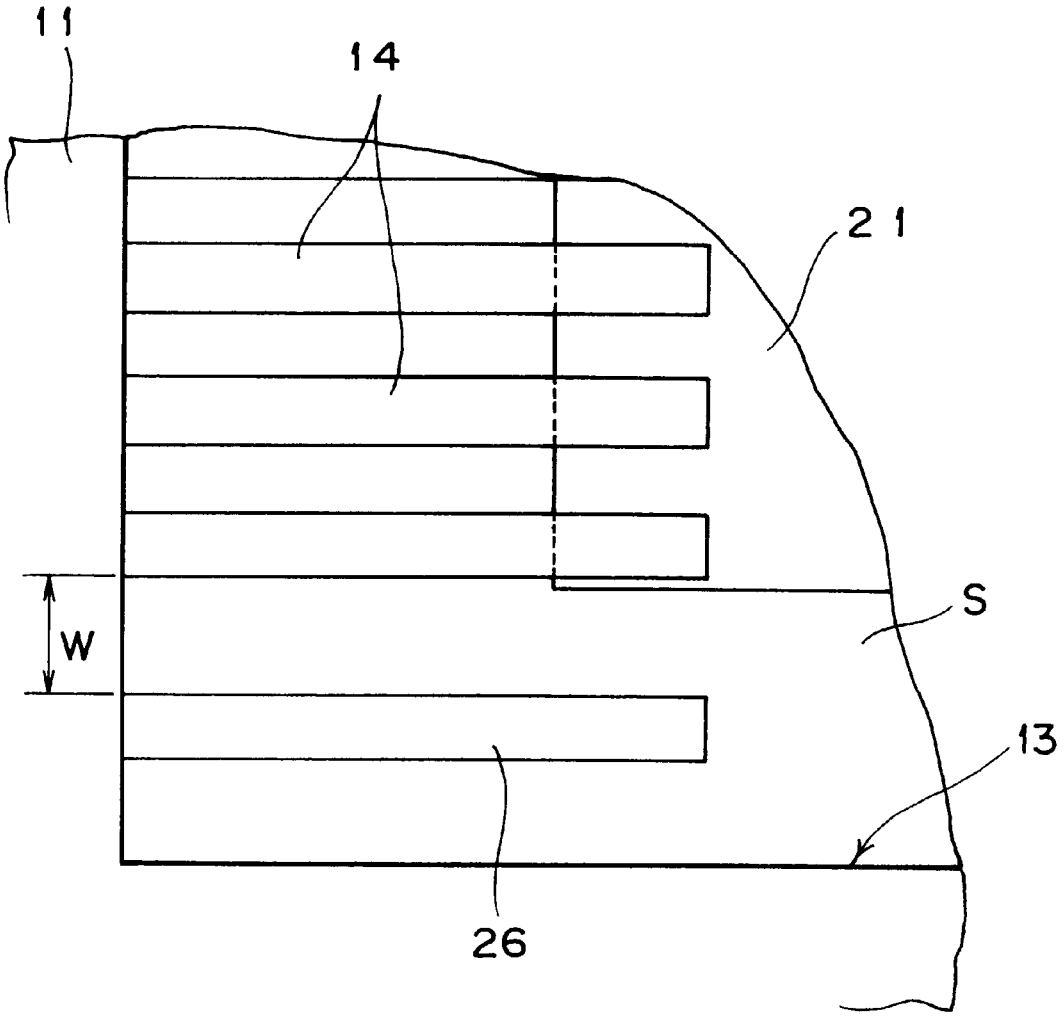
FIG. 5 is an extracted enlarged section of a portion of arrow V of FIG. 4.

The inventors have found that when a viscosity of the seal resin 16 is lowered upon curing of the seal resin 16 by heating or other way, if an interval between the lead terminals 14 in the width direction is set to be greater than or equal to 0.05 mm and less than or equal to 0.5 mm, and more preferably greater than or equal to 0.1 mm and less than or equal to 0.3 mm, the seal resin 16 hardly flows to the back side of the electrical wiring substrate 11. Thus, as shown in FIG. 4 illustrating the mating condition of the head chip 12 and the electrical wiring substrate 11 before application of the seal resin 16 and FIG. 5, in which the portion pointed by arrow V is extracted and enlarged, the dummy lead terminals 26 are arranged on the upper and lower sides of the lead terminals 14 located at upper and lower end portions, with projecting into the gap S between the head chip 12 and the chip installation hole 13. Intervals W in the width direction between the dummy lead terminals 26 and the adjacent lead terminals 14 and the width of the gap defined between the dummy lead terminals 26 and the inner periphery of the chip installation hole 13, and the width of the gap between the head chip 12 and the chip installation hole 13 in other portion where the seal resin 16 is applied, are set to be greater than or equal to 0.05 mm and less than or equal to 0.5 mm, and more preferably greater than or equal to 0.1 mm and less than or equal to 0.3 mm (0.1 mm in the shown embodiment). Accordingly, during curing of the seal resin 16, the seal resin 16 may hardly flow to the back side of the electric wiring substrate 11 and whereby can maintain the condition as illustrated in FIG. 1.

It is desirable to completely seal the gap between the head chip 12 and the chip installation hole 13 by applying the seal resin 16 in the gap S defined between the head chip 12 and the chip installation hole 13 in the portion other than the connecting portion, in post process, finally. For this purpose, in order to accommodate a needle of a dispenser to be used for application of the seal resin, the width of the gap S between the head chip 12 and the chip installation hole 13 in the portion other than the connecting portion along the alignment direction of the lead terminals 14 (the spacing along the vertical direction in FIG. 4), is set to be greater than or equal to 0.7 mm and less than or equal to 2.0 mm, and more preferably to be greater than or equal to 0.8 mm and less than or equal to 1.5 mm (1.0 mm in the shown embodiment).

The seal resin 16 employed in the shown embodiment is a solventless epoxy resin (e.g. Chip Coat 8304, available from Hokuriku Toryo Co. which has changed to NAMICS Co.). The needle for applying the seal resin 16 is in a range of gauge 18 to 23. However, the kind of the needle may be selected depending upon amount to be applied and application speed.

The fabrication process of such ink-jet head will be explained hereinafter. On a silicon substrate as the ejection element substrate 21, a heating resistance layer and an electrode layer are formed. Then, by way of photolithography, heating portions (electrothermal transducers 20) are formed. Next, a protective layer is formed. Then, contact hole is formed at a portion to establish electrical connection by photolithography. In the shown embodiment, in order to establish electrical connection with the lead terminals 14 of the electric wiring substrate 11, a metal layer, such as gold layer, is formed. Then, by way of photolithography, electrode terminal is formed. Thus, the ejection element substrate 21 is completed. Subsequently, in order to form the communication passage 25, an aperture is formed through the ejection element substrate 21 by blasting method. Then, the liquid passage 22 is formed with a dry film by way of photolithography. On the ejection element substrate 21, thus formed, a grooved plate 24 formed by electroforming, is bonded. The head chip 12 thus completed is agglutinated with a support member 29. Then, the electric wiring substrate 11 is agglutinated with the mold member 17 so that the lead terminals 14 of the electric wiring substrate 11 overlappingly mate with the electrode terminals of the head chip 12. Thereafter, the lead terminals 14 and the electrode terminals of the head chip 12 are joined by TAB junction.

In this embodiment, the dummy lead terminals 26 is formed in the same configuration as the lead terminal 14. However, the dummy lead terminals 14 may also be formed as projections extending from respective corner portions of the chip installation hole 13.

Figure 6:
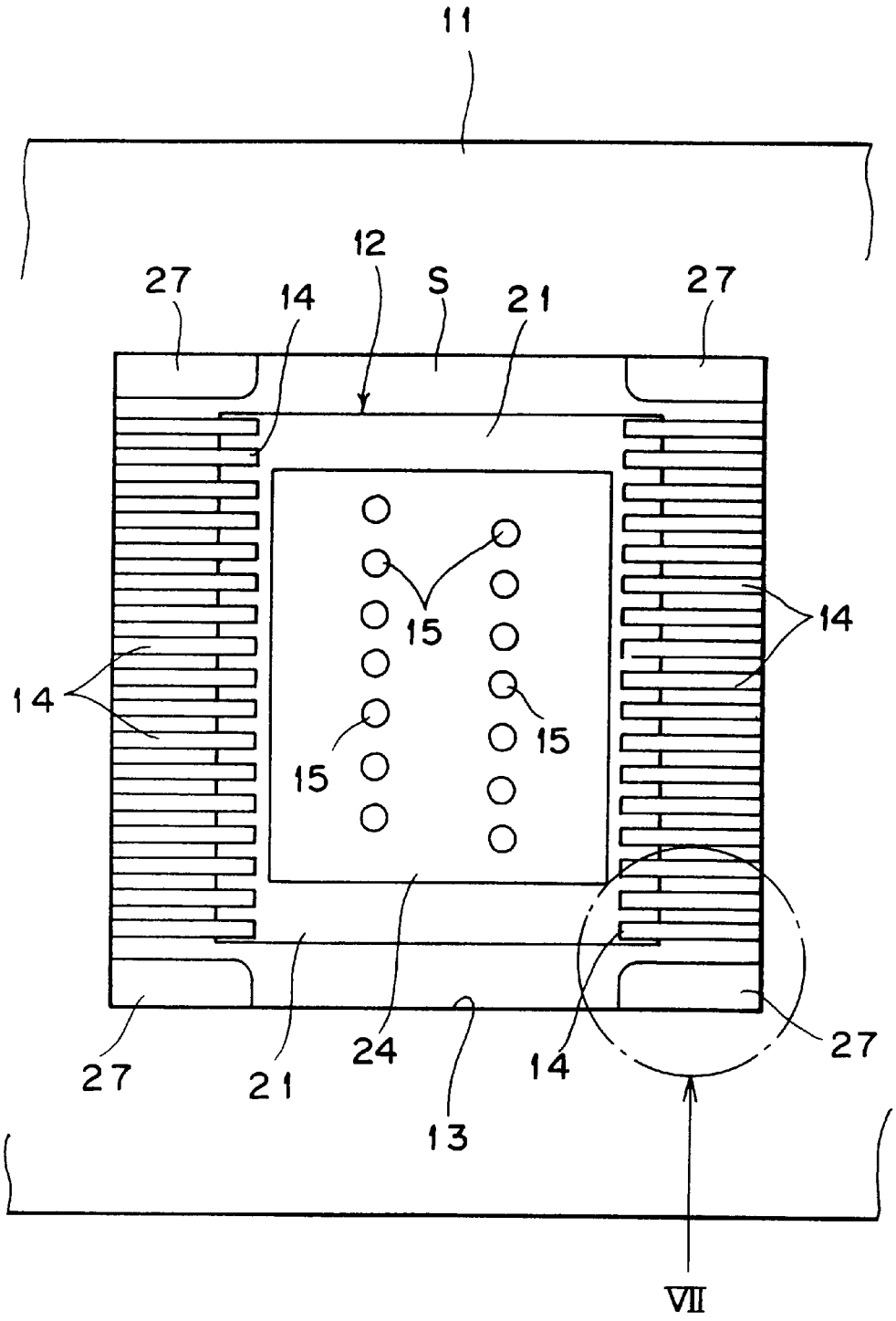
FIG. 6 is a plan view showing a condition on the way of another embodiment of fabrication process of the ink-jet head of the present invention.
Figure 7:
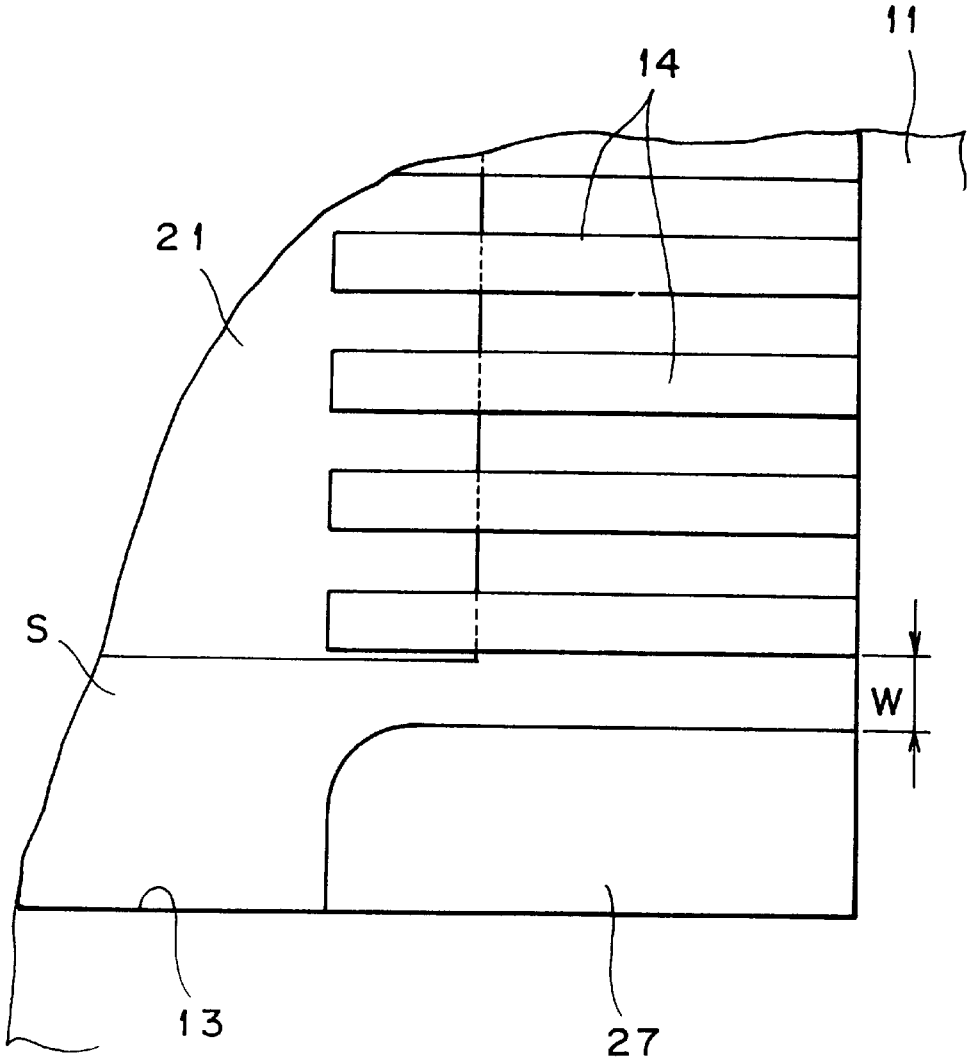
FIG. 7 is an extracted enlarged view of a portion of arrow VII of FIG. 6.

Another embodiment of the ink-jet head according to the present invention is illustrated in FIG. 6 showing the connected condition but then seal resin is not yet applied, and in FIG. 7 which shows the portion pointed by the arrow VII in the extracted and enlarged form. In the following disclosure, like elements to the former embodiment will identified by the like reference numeral, and the redundant disclosure for these elements will be neglected.

At four corners of the chip installation hole 13, resin catching portions 27 are extended. A distance W between the resin catching portion 27 and the lead terminal 14 located the closest to the resin catching portion 27 is set to be greater than or equal to 0.05 mm and less than or equal to 0.5 mm, and more preferably to be greater than or equal to 0.1 mm and less than or equal to 0.3 mm (0.1 mm in the shown embodiment). When the distance between the resin catching portion 27 and the head chip 12 is smaller than the distance W between the resin catching portion 27 and the lead terminal 14 located the closest to the resin catching portion 27, it is desirable to set the distance between the resin catching portion 27 and the head chip 12 within a range of greater than or equal to 0.05 mm and less than or equal to 0.5 mm, and more preferably to be greater than or equal to 0.1 mm and less than or equal to 0.3 mm.

Figure 8:
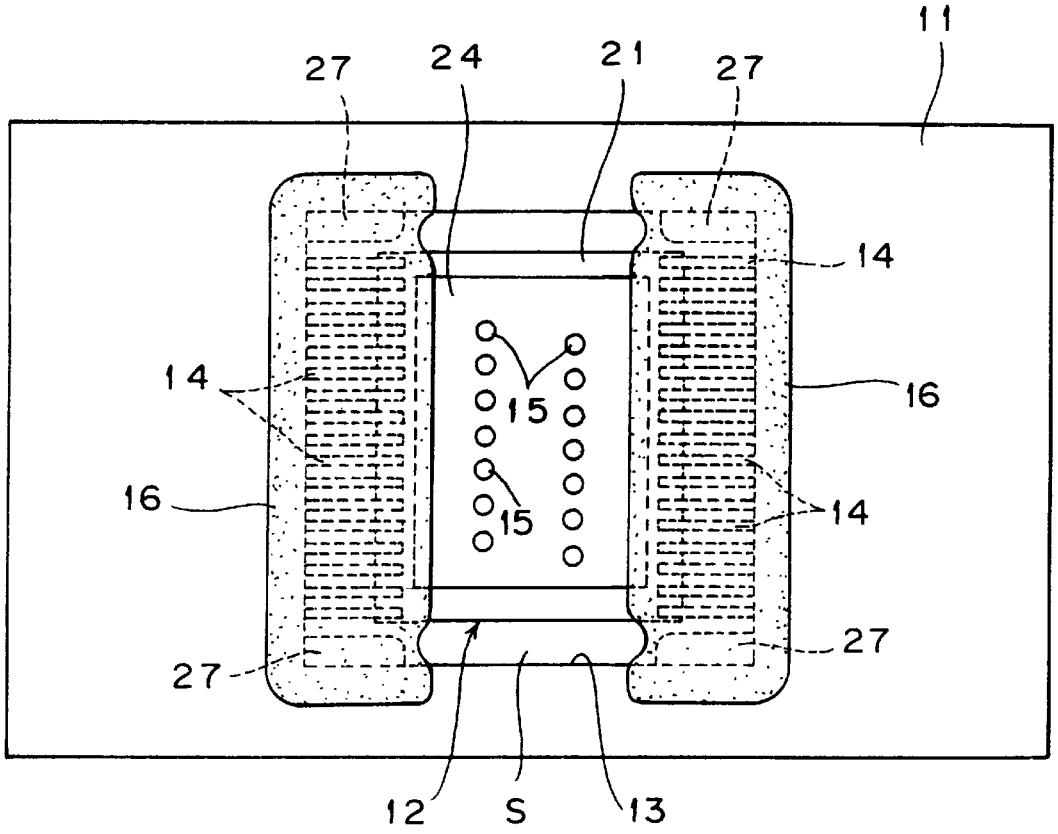
FIG. 8 is a plan view of the ink-jet head of the embodiment shown in FIGS. 6 and 7.

Accordingly, as shown in FIG. 8, in which is illustrated a plan view after application of the seal resin 16, the seal resin 16 may not flow to back side of the electrical wiring substrate 11 to maintain the configuration after application.

In the foregoing two embodiments, the lead terminals 14 are projected from opposing two side edges of the quandrangular chip installation hole 13, and the seal resin 16 is applied along these two side edges, it is possible to apply the seal resin over the entire circumference of the chip installation hole 13. In this case, the dimension in the width direction of the gap S in the portion where the lead terminal 14 is not formed, has to be greater than or equal to 0.05 mm and less than or equal to 0.5 mm, and more preferably to be greater than or equal to 0.1 mm and less than or equal to 0.3 mm.

Figure 9:
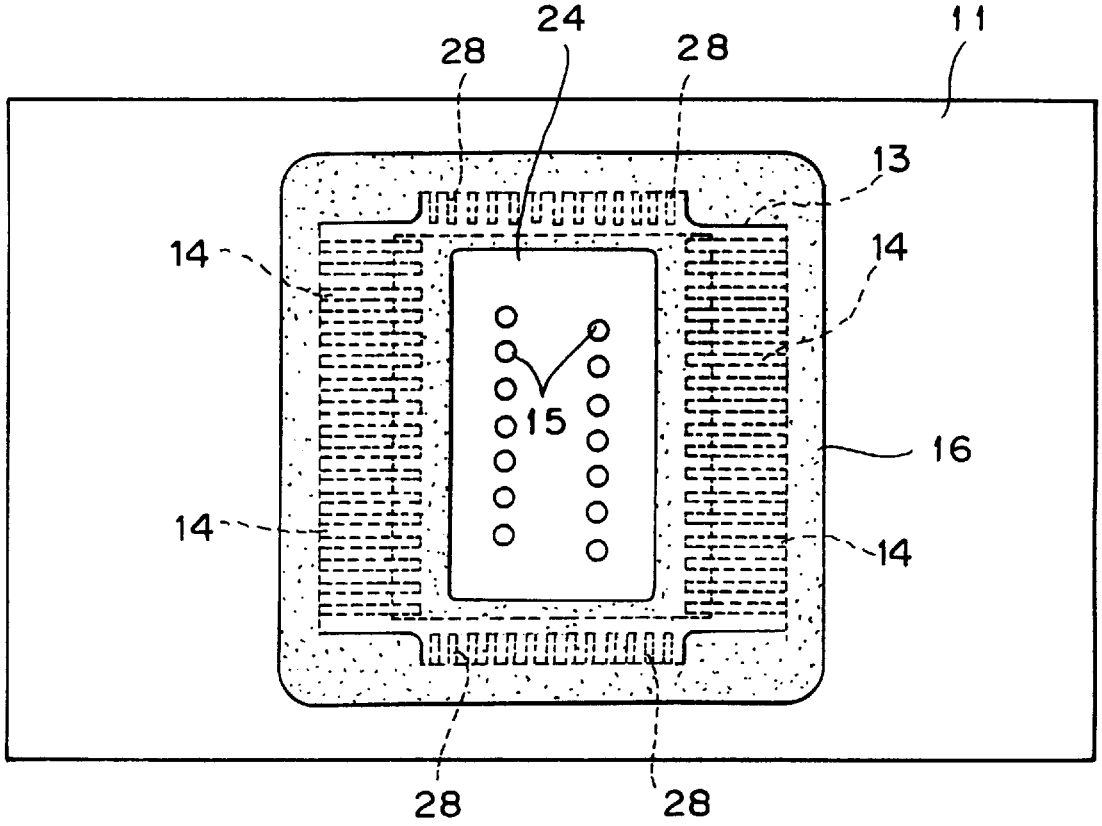
FIG. 9 is a plan view of a further embodiment of the ink-jet head according to the present invention.

A configuration in plan view of another embodiment of the ink-jet head according to the present invention is shown in FIG. 9. In FIG. 9, like elements to those in the former embodiment will be identified by like reference numerals and redundant disclosure for these elements will be neglected for simplicity of disclosure. On the opposing side edges of the chip installation hole 13, where no lead terminal 14 is provided, a plurality of dummy lead terminals 28 are extended. An internal between adjacent dummy lead terminals 28 is set to be greater than or equal to 0.05 mm and less than or equal to 0.5 mm and more preferably to be greater than or equal to 0.1 mm and less than or equal to 0.3 mm (0.1 mm in the shown embodiment). The distance between the tops of each dummy lead terminals 28 and the lead chip 12 is set be greater than or equal to 0.1 mm and legs than or equal to 0.3 mm. Therefore, even when the seal resin 16 is applied along the entire circumference of the chip installation hole 13 to seal the gap between the head chip 12 and the electrical wiring substrate 11, the seal resin 16 will not flow around the back surface of the electrical wiring substrates 11 to maintain the shape immediately after application similarly to the former embodiment.

In the embodiment shown, the dimension along the width of the chip installation hole 13 along the aligning direction of a plurality lead terminals 14 in the TAB connection portion, is set to be narrower than that of the other portion. As a result, the contour of the chip installation hole 13 becomes substantially the same as that illustrated in FIGS. 6 to 8. In the embodiment shown, since the entire circumference of the head chip 12 is connected to the electrical wiring substrate 11 via the seal resin 16, the strength of connection between the electrical wiring substrate 11 and the head chip 12 can be greater than those in the former two embodiments. Furthermore, since the chip installation hole 13 is completely sealed by the seal resin 16, the liquid will never flow around the back surface side of the electrical wiring substrate 11.

Figure 10:
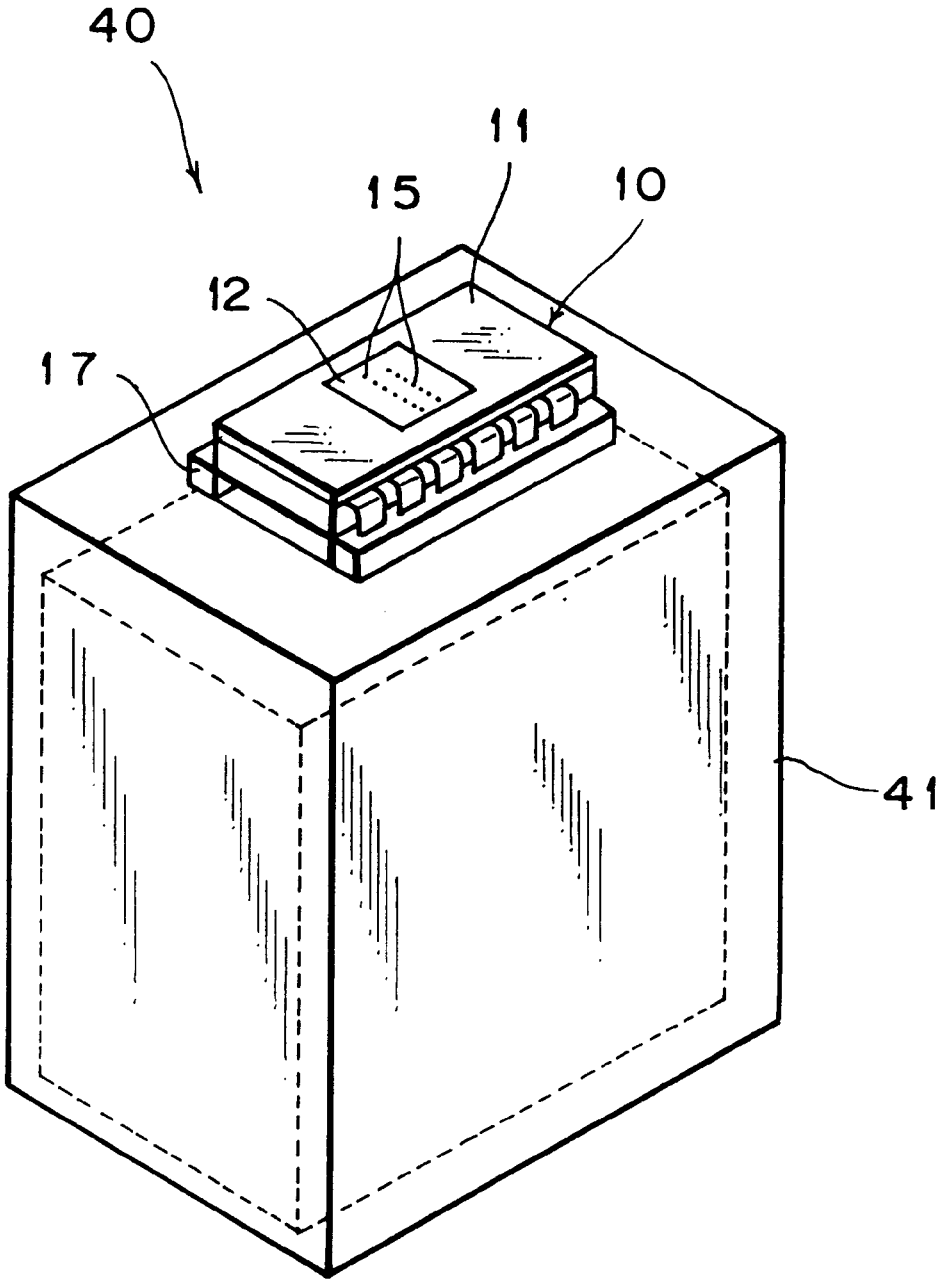
FIG. 10 is a perspective view showing an external view of one embodiment of an ink-jet cartridge according to the present invention.
Figure 11:
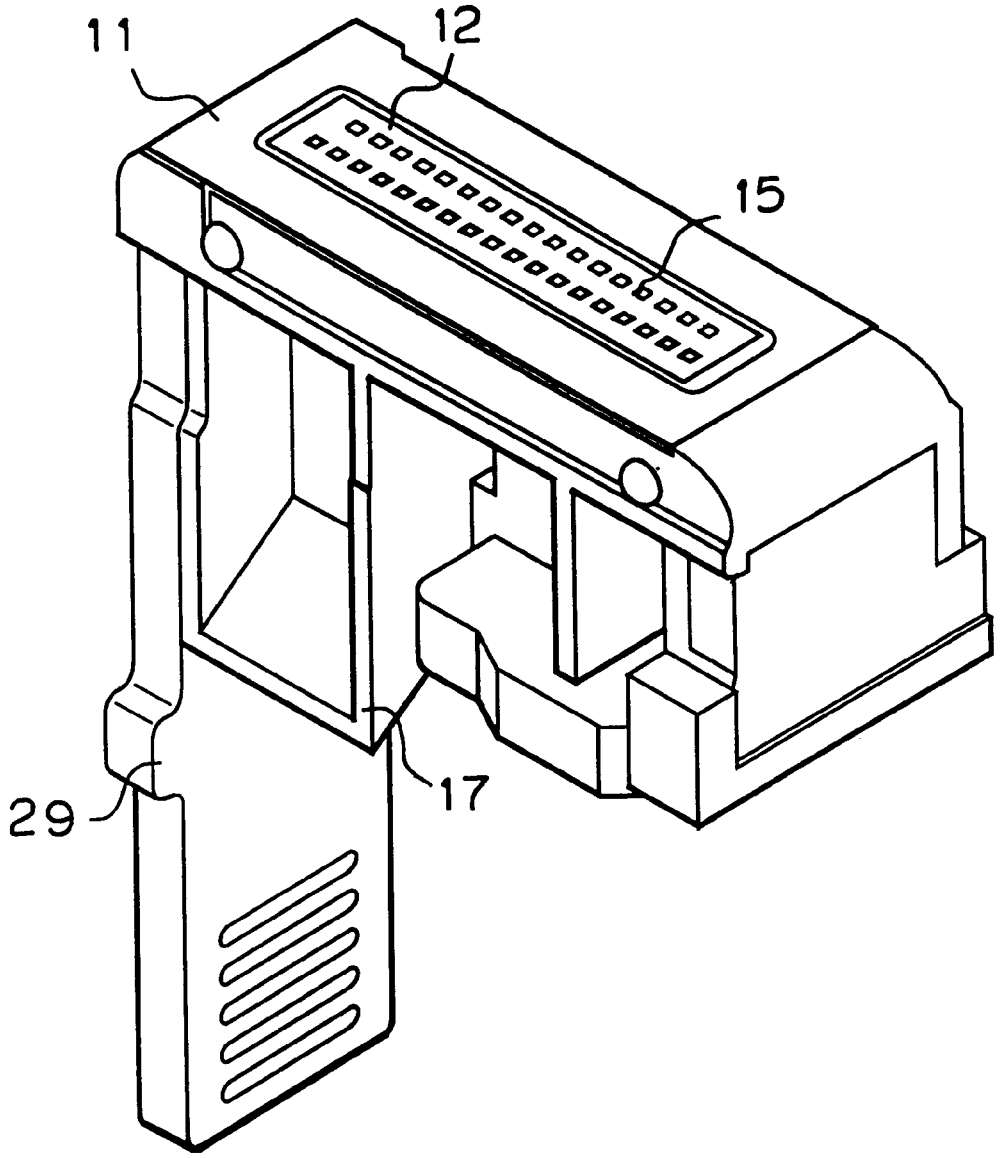
FIG. 11 is a exploded view showing an external view of the ink-jet head shown in FIG. 10.

Next, an external view of a liquid ejection head cartridge according to the present invention employing the ink-jet head shown in FIGS. 1 to 3, namely an ink-jet head cartridge (hereinafter referred to as head cartridge) is shown in FIG. 10, and an external view of the major portion thereof is shown in FIG. 11. A head cartridge 40 as illustrated is a serial type, and the major portion is constituted of the ink-jet head 10 and a liquid tank 41 storing a liquid, such as an ink.

The ink-jet head 10 formed with a plurality of ejection openings 15 for ejecting the liquid, corresponds that partially shown in FIGS. 1 to 3. The liquid, such as the ink is introduced into the common liquid chamber 23 in the head chip 12 from the liquid tank 41 via the liquid supply passage 19 (see FIG. 2) of the mold member 17.

The head cartridge 40 in the shown embodiment is constructed by integrally forming the ink-jet head 10 and the liquid tank 41. However, it is also possible to construct the liquid tank 41 to be exchangeable with respect to the ink-jet head 10.

Figure 12:
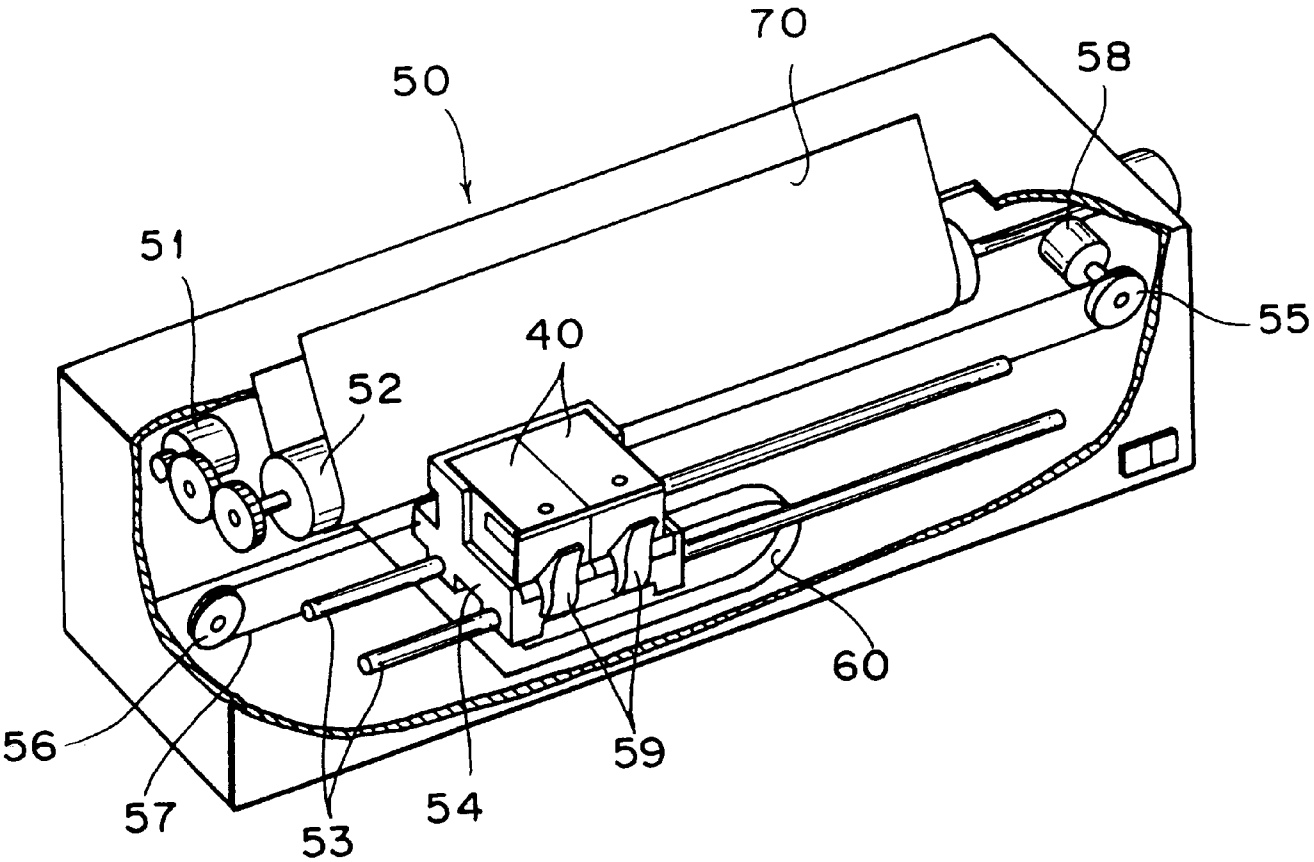
FIG. 12 is a respective view showing an external view of one embodiment of an ink-jet printing apparatus according to the present invention.

An external view of an ink-jet printing apparatus (hereinafter referred to as printing apparatus) according to the present invention employing the head cartridge 40 as set forth above is illustrated in FIG. 12. In the shown embodiment of the printing apparatus, on a pair of guide bars 53 which are arranged in parallel to a platen roller 52 driven to rotate by a feeding motor 51, a carriage 54 is slidably mounted. On a pair of pulleys 55 and 56 rotatably mounted on both ends of the guide bar 53, a scanning wire 57 is wound around to extend along the guide bar 53. Both ends of the scanning wire 57 are connected to carriage 54. To one of the pulley 55, a carriage driving motor 58 is connected. Thus, by driving of the carriage driving motor 58 in forward to reverse direction, the carriage 54 is moved for scanning in the longitudinal direction along the platen roller 52 as being guided by the guide bars 53.

On the carriage 54, a head cartridge 40 shown in FIG. 11 is mounted in positioned condition. The head cartridge 40 is exchangeable via an operation lever 59 for attaching and detaching. The ejection openings 27 of the ink-jet head 10 opposes with a printing medium 70, such as a paper fitted on the platen roller 52 with a predetermined clearance. On the ink-jet head 10, an ejection signal for the ink corresponding to a data from arbitrary data supply source, is supplied via a flexible cable 60 connected to the carriage 54. Then, by a feeding operation of the printing medium 70 by the feeding motor 51 and scanning motion of the carriage 54 by the carriage driving motor 58, a desired data can be printed at the predetermined position of the printing medium 70.

The one or more head cartridge 40 (two in the shown example) can be mounted on the carriage 54. While as the foregoing ink-jet head 10, the serial type ink-jet head is employed in the shown embodiment, it is possible to apply the head cartridge employing a fully-line type ink-jet head and other printing system.

Figure 13:
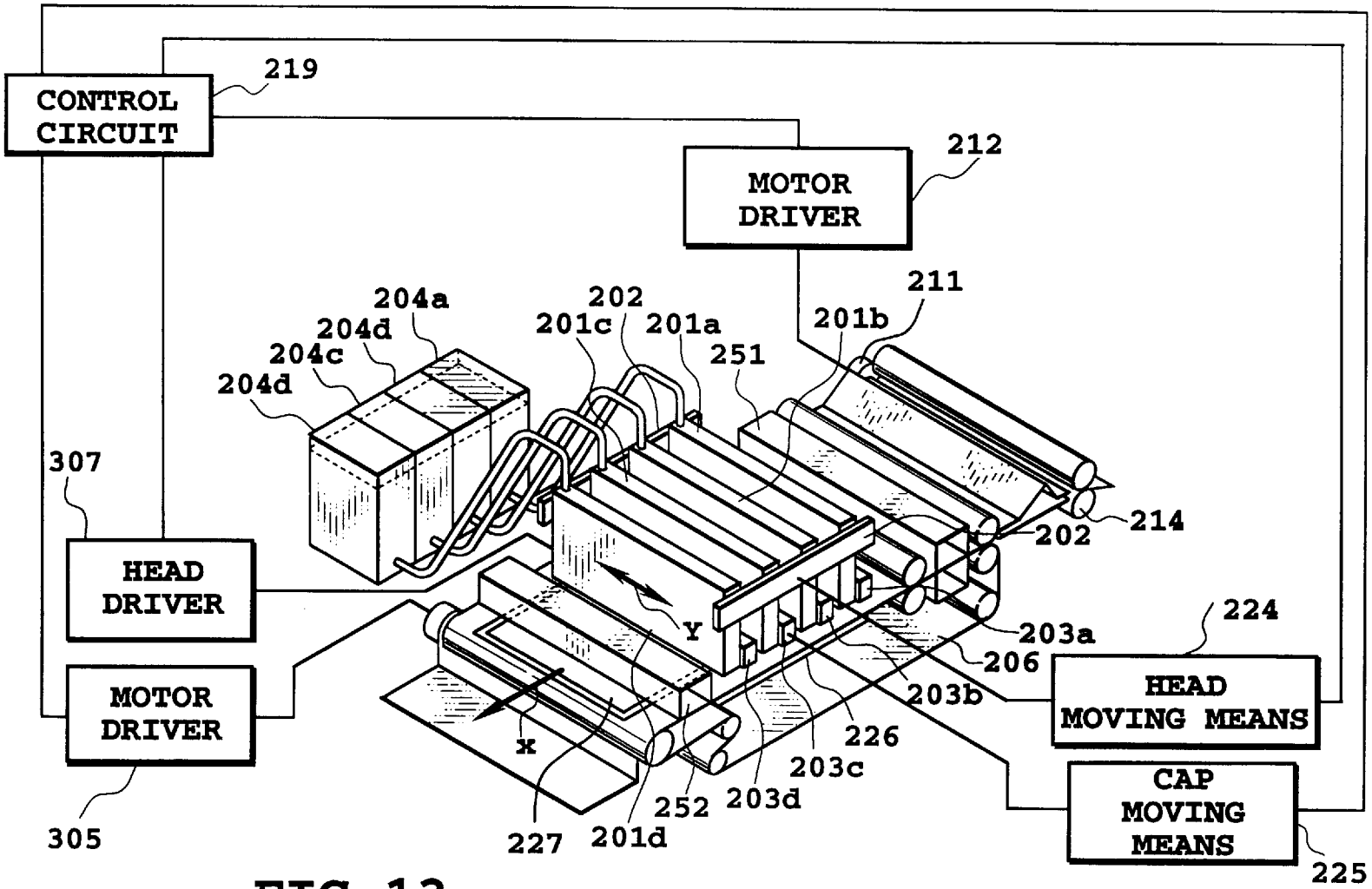
FIG. 13 is a diagrammatic illustration showing one embodiment of an ink-jet printing system according to the present invention.
Figure 14:
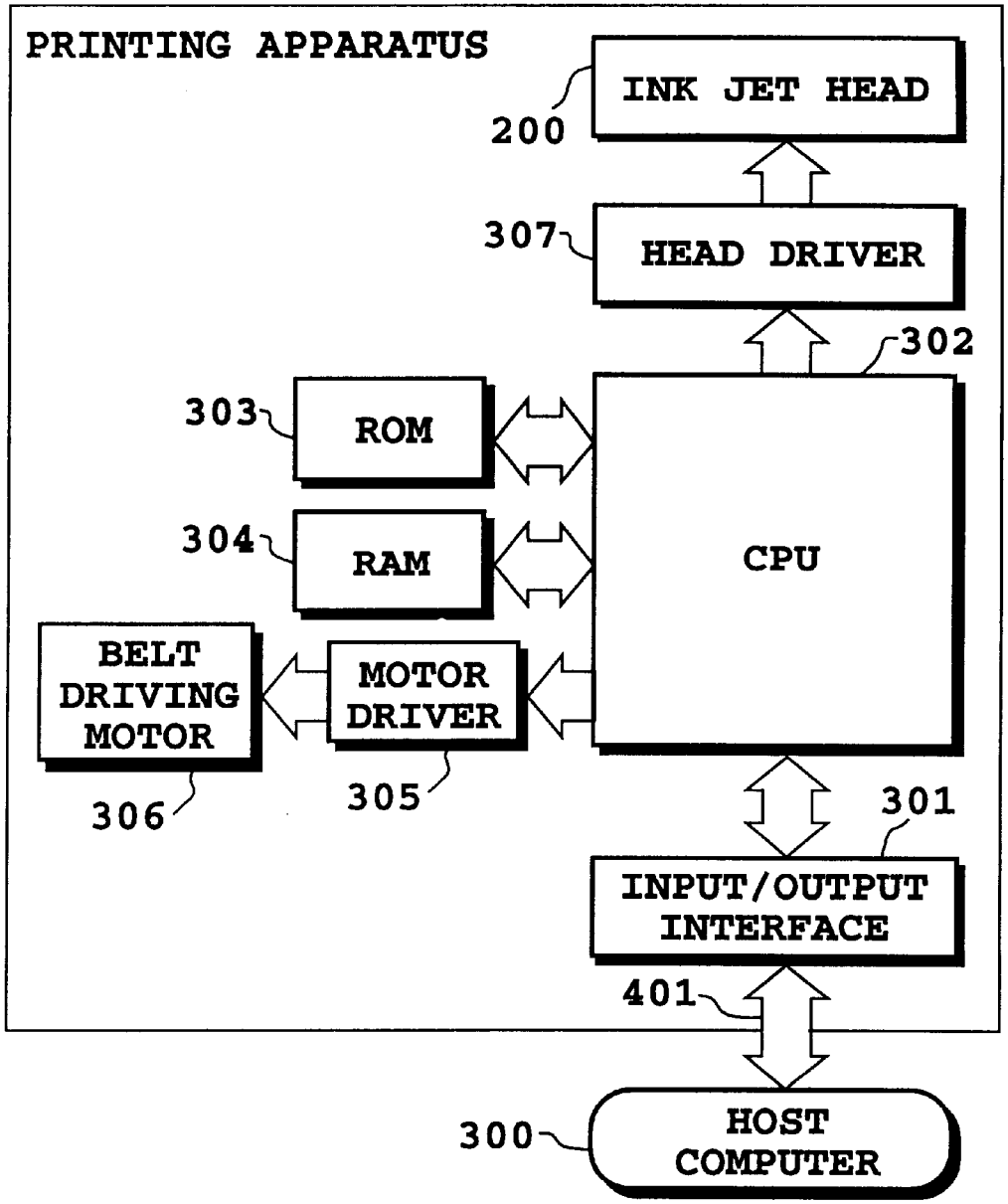
FIG. 14 is a block diagram showing control system of the ink-jet printing system shown in FIG. 13.
Figure 15:
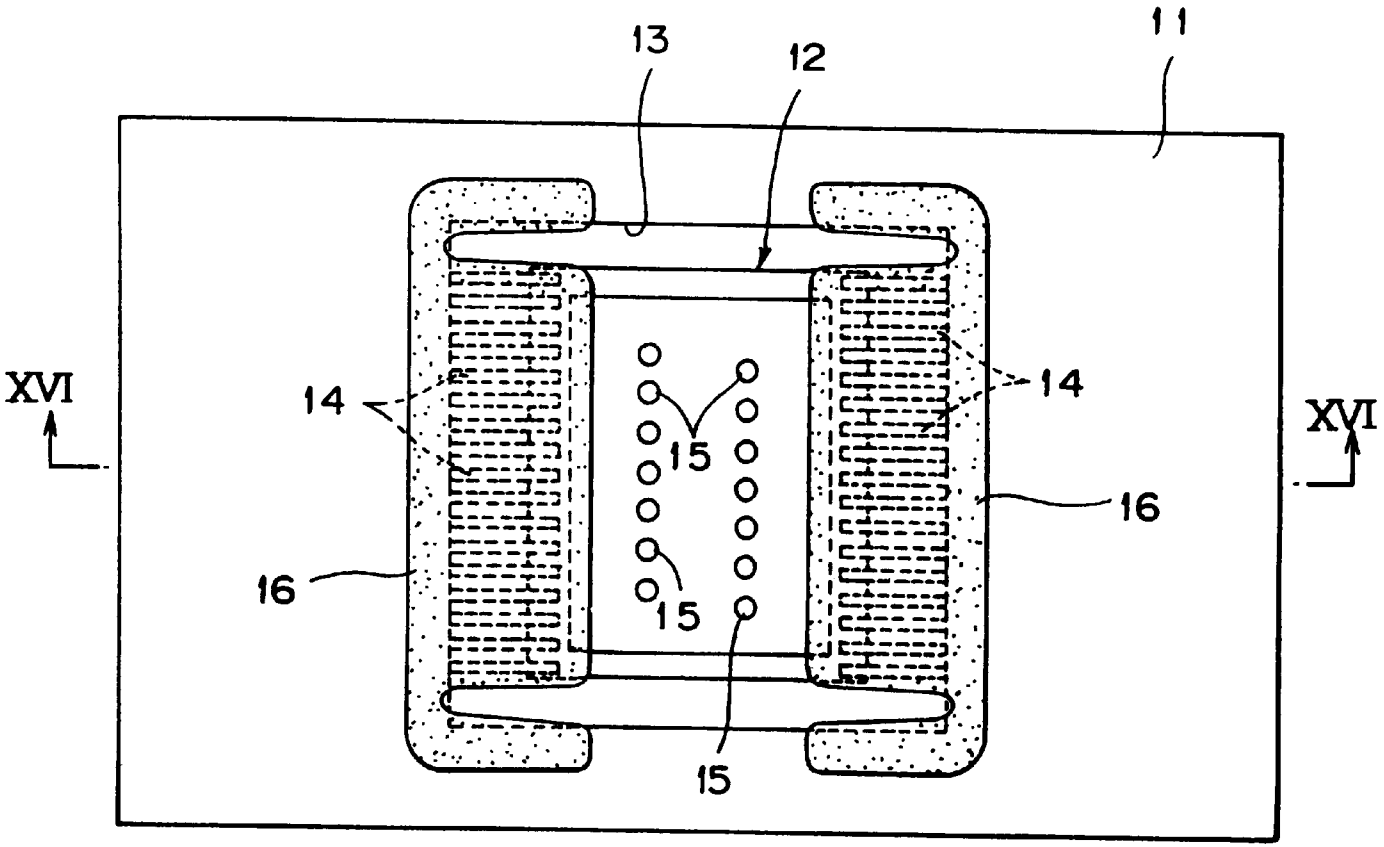
FIG. 15 PRIOR ART
FIG. 15 is a plan view of the major portion of the conventional ink-jet head as an object of the present invention.
Figure 16:
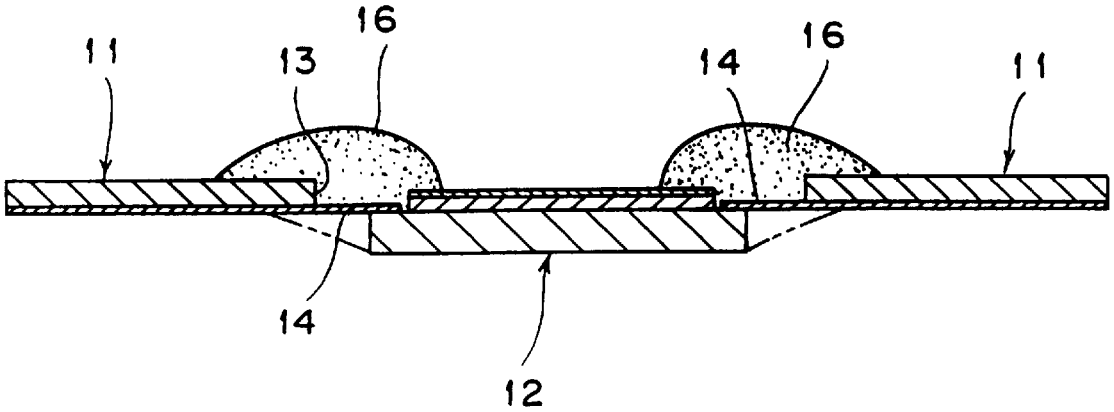
FIG. 16 PRIOR ART
FIG. 16 is a section taken along line XVI—XVI of FIG. 15.
Figure 17:
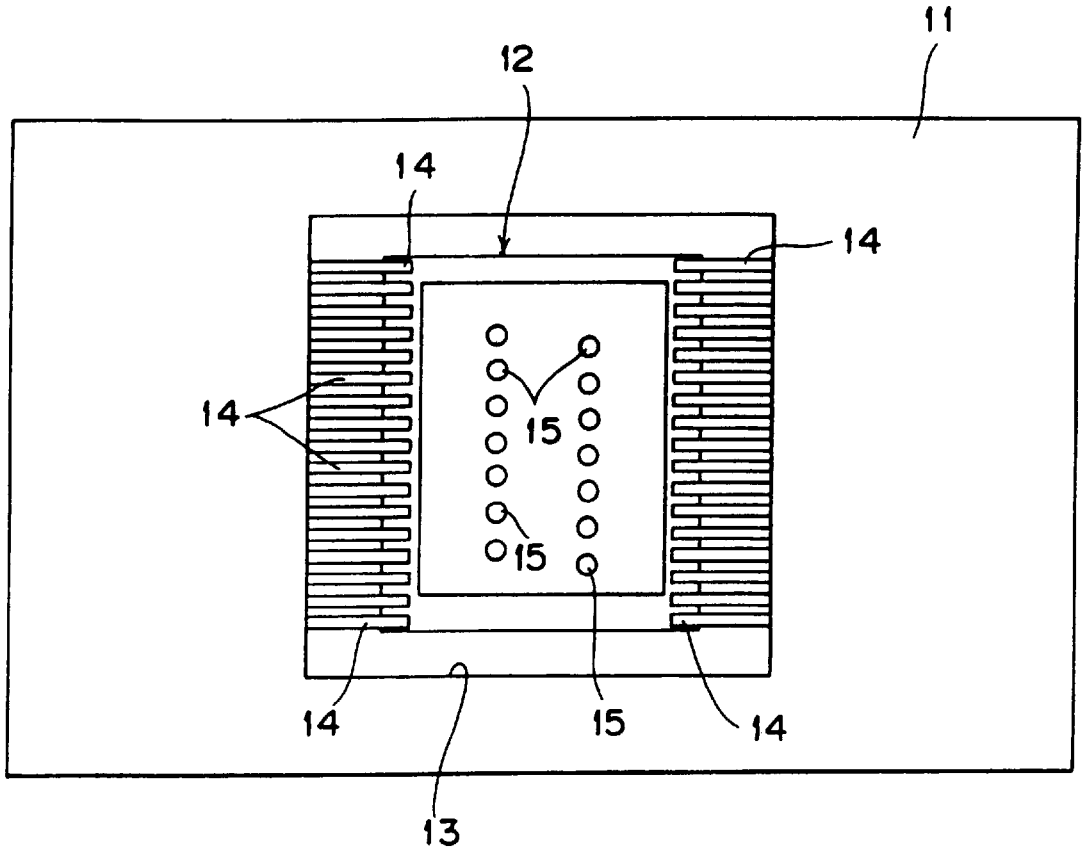
FIG. 17 PRIOR ART
FIG. 17 is a plan view showing a condition on the way of the fabrication process of the ink-jet head shown in FIGS. 15 and 16 before application of the seal resin.

A printing system according to the present invention is illustrated in FIG. 13. A block diagram of the control system for the printing system is shown in FIG. 14. The shown printing system includes four ink tanks 204*a,* 204*b,* 204*c* and 204*d* respectively storing a yellow ink, magenta ink, cyan ink and black ink (hereinafter generally referred to as the ink tank 204), and four ink-jet heads 201*a,* 201*b,* 201*c* and 201*d* (hereinafter generally referred to as ink-jet head 201) respectively connected to the ink tanks 204. In the ink-jet head 201, not shown ejection openings are formed downwardly at a resolution of 360 dpi in Y direction, corresponding to the overall the entire width of a printing region in the printing medium 227.

The ink-jet heads 201, in each of which power supply for respective of not shown electrothermal transducers is turned ON/OFF by head drivers 307 connected to the control circuit 219, are arranged at a predetermined interval along a transporting direction X of an endless transporting belt 206 in opposition to the platen 226 across the transporting belt 206. By a head moving means 224 controlled the operation thereof by the control circuit 219 for performing a recovery process, the ink-jet heads 201 are moved up and down with respect to the platen 226. On the side portion of the ink-jet heads 201 mutually connected by means of a holder 202, capping members 203*a,* 203*b,* 203*c* and 203*d* (hereinafter generally referred to as capping members 203) for performing recovery process for the ink-jet heads 210 by performing preparatory ejection with ejecting old ink in the not shown ink passages formed in the ink-jet heads 201, are arranged with a half pitch offset condition with respect to an arrangement interval of the ink-jet head 201. By a cap moving means 225, operation of which is controlled by the control circuit 219, the capping member 203 is moved immediately below the ink-jet heads 201 to receive the waste ink ejected from the ejection openings during preparatory ejection.

The transporting belt 206 transporting the printing medium 227 is wrapped around a driving roller 214 which is, in turn, connected to a belt driving motor 306. The operation of the transporting belt 206 is switched by a motor driver 305 connected to the control circuit 219. To a pair of feeding rollers 214 for supplying the printing medium 227 to the transporting belt 206, the feeding motor 211 for switching operation by the motor driver 212. By the feeding motor 211, the pair of feeding rollers 214 are driven to rotate.

In the ink-jet type printing system exemplified in the shown embodiment, there are provided a pre-treatment device 251 and post-treatment device 252 to perform various process for the printing medium 227 before or after printing. The pre-treatment device 251 and post treatment 252 are provided at upstream side and the downstream side of the transporting passage of the printing medium 227.

The pre-treatment and post-treatment are differentiated the content depending upon the kind of the printing medium 227 and the kind of ink to perform printing. For example, printing medium 227 can include materials such as metal, plastic, and ceramics. These materials can be subjected to a pre-treatment, such as exposure to ultraviolet rays or ozone, to make the surface more active and so improve the material's ability to have ink deposited thereon. In the case where the printing material 227 readily undergoes static electric charging, such as is the case with plastic, and whereby dust is easily absorbed on the surface, that dust may be a hazard for high quality printing. In this situation, static electricity is removed from the printing medium 227 by means of an ionizer device, which serves to remove the dust. Also, when cloth is employed as the printing medium 227, a pre-treatment process involving the addition of material such as an alkaline substance, water-soluble metal salt, urea, or thiourea is performed. The pre-treatment should not be limited to those as explained and can be a process for adjusting the temperature of the printing medium 227 at an appropriate temperature for printing.

The post process may be a heat treatment, fixing process for promoting fixing of the ink ejecting to the printing medium 227 by irradiation of the ultraviolet ray, a process for washing the processing liquid applied in the pre-treatment and residing without reaction, and the like.

Accordingly, in advance of printing operation for the printing medium 227, the ink-jet heads 201 are elevated upwardly away from the platen 226 to the recovering position. Then, the capping members 203 are moved immediately below the ink-jet head 201 to perform recovery process of the ink-jet head 201. Thereafter, the capping members 203 are returned to the initial and stand-by position. Then, the ink-jet head 201 is moved down to an image forming position or toward the platen 226. Then, an electrifier (not shown) is actuated. In conjunction therewith, the transporting belt 206 is driven. Then, the printing medium 227 is mounted on the transporting belt 206 by the feeding roller 214. Then, predetermined color images are formed on the printing medium 227 by respective ink-jet heads 201.

The printing apparatus receives a printing information control signal from a host computer 300. The printing information is temporarily stored in an input interface 301 in the printing apparatus, and in conjunction therewith, converted into data which can be processed in the printing apparatus to be input to CPU 302 acting commonly as the head driving signal supply means. CPU 302 processes the input data using the peripheral unit, such as RAM 204 on the basis of a control program stored in ROM 303 to convert into printing data (image data).

CPU 302 generates driving data for driving the belt driving motor 306, the feeding motor 211 for transporting the printing medium 227 synchronously with the image data, and the ink-jet heads 201, for printing at an appropriate position on the printing medium 227. The image data and the motor driving data which are transmitted to the ink-jet head 201 are transmitted to the ink-jet heads 201 and the belt driving motor 306 via the head driver 307 and the motor drivers 305 and 212 for driving at controlled timing to form the image.

The present invention achieves distinct effect when applied to a liquid ejecting head or a recording apparatus which has means for generating thermal energy such as electrothermal transducers or laser light, and which causes changes in the liquid by the thermal energy so as to eject the liquid. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid, and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the liquid ejecting head; and third, bubbles are grown in the liquid corresponding to the drive signals. By using the growth and collapse of the bubbles, the liquid is expelled from at least one of the liquid ejection openings of the head to form one or more liquid drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a liquid ejecting head, which is incorporated to the present invention: this structure includes heating portions disposed on bent portions in addition to a combination of the ejection openings, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection openings of the electrothermal transducers, and the latter discloses a structure in which openings for absorbing pressure waves caused by thermal energy are formed corresponding to the ejection openings. Thus, irrespective of the type of the liquid ejecting head, the present invention can achieve recording positively and effectively.

It is further preferable to add a recovery system, or a preliminary auxiliary system for a liquid ejecting head as a constituent of the recording apparatus because they serve to make the effect of the present invention more reliable. As examples of the recovery system, are a capping means and a cleaning means for the liquid ejecting head, and a pressure or suction means for the liquid ejecting head. As examples of the preliminary auxiliary system, are a preliminary heating means utilizing electrothermal transducers or a combination of other heater elements and the electrothermal transducers, and a means for carrying out preliminary ejection of liquid independently of the ejection for recording. These systems are effective for reliable recording.

The number and type of liquid ejecting heads to be mounted on a recording apparatus can be also changed. For example, only one liquid ejecting head corresponding to a single color ink, or a plurality of liquid ejecting heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different colors, and the full-color mode performs recording by color mixing. In this case, it may be effective that the treatment liquid (printing ability enhancing liquid) for adjusting the printing ability of the ink depending upon the printing medium is ejected from the liquid ejection head.

In addition, as the form of the printing apparatus according to the present invention, in addition to that employed as an image output terminal of an information processing system, such as computer, which performs printing for the printing medium, such as paper, cloth leather, metal, plastic, glass, wood or ceramic, it can also be a facsimile machine having transmitting and receiving function, a textile printing apparatus and the like.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A liquid ejection head comprising:

a head chip having a plurality of ejection openings, ejection energy generating means for ejecting a liquid from said ejection openings, and a liquid chamber communicated with said ejection openings and being supplied with a liquid;

an electrical wiring substrate formed with a chip installation hole, said head chip being disposed in said chip installation hole;

a plurality of lead terminals projecting into said chip installation hole of said electrical wiring substrate and being connected to said head chip for supplying electric power to said ejection energy generating means;

a sealing material layer sealing a connecting portion between said lead terminals and said head chip; and a protrusive resin catching portion for catching said sealing material, said protrusive resin catching portion being provided in a gap between said chip installation hole and said head chip.

2. A liquid ejection head as claimed in claim 1, wherein said protrusive resin catching portion is a dummy lead terminal formed on said electric wiring substrate.

3. A liquid ejection head as claimed in claim 1, wherein said protrusive resin catching portion is formed by having a width of said chip installation hole along the aligning direction of said plurality of lead terminals in said connecting portion be narrower than a width of an other portion.

4. A liquid ejection head as claimed in any one of claims 1 to 3, wherein a width of a gap between said protrusive resin catching portion and said lead terminal closest to said protrusive resin catching portion, or a width of a gap between said protrusive resin catching portion and the inner periphery of said chip installation hole is greater than or equal to 0.05 mm and less than or equal to 0.5 mm, and preferably greater than or equal to 0.1 mm and less than or equal to 0.3 mm.

5. A liquid ejection head as claimed in claim 3, wherein the width of said chip installation hole along the aligning direction of said plurality of lead terminals other than said connecting portion is greater than or equal to 0.7 mm and less than or equal to 2.0 mm, and more preferably to be greater than or equal to 0.8 mm and less than or equal to 1.5 mm.

6. A liquid ejection head as claimed in any one of claims 1 to 3, wherein said ejection openings are arranged in opposition to said ejection energy generating means.

7. A liquid ejection head as claimed in any one of claims 1 to 3, wherein said ejection energy generating means is an electrothermal transducer having a heating resistor generating a heat when an electric signal is applied.

8. A liquid ejection head as claimed in any one of claims 1 to 3, wherein said sealing material is a solventless epoxy resin.

9. A liquid ejection head cartridge including a liquid ejection head and a liquid tank storing a liquid for supplying to said liquid ejection head, comprising:

said liquid ejection head including a head chip having a plurality of ejection openings, ejection energy generating means for ejecting a liquid from said ejection openings, and a liquid chamber communicated with said ejection openings and being supplied with a liquid, an electrical wiring substrate formed with a chip installation hole, said head chip being disposed in said chip installation hole, a plurality of lead terminals projecting into said chip installation hole of said electrical wiring substrate and being connected to said head chip for supplying electric power to said ejection energy generating means, and a sealing material layer sealing a connecting portion between said lead terminals and said head chip; and a protrusive resin catching portion for catching said sealing material, said protrusive resin catching portion being provided in a gap between said chip installation hole and said head chip.

10. A liquid ejection head cartridge as claimed in claim 9, wherein said protrusive resin catching portion is a dummy lead terminal formed on said electric wiring substrate.

11. A liquid ejection head cartridge as claimed in claim 9, wherein said protrusive resin catching portion is formed by having a width of said chip installation hole along the aligning direction of said plurality of lead terminals in said connecting portion be narrower than a width of an other portion.

12. A liquid ejection head cartridge as claimed in any one of claims 9 to 11, wherein a width of a gap between said protrusive resin catching portion and said lead terminal closest to said protrusive resin catching portion, or a width of a gap between said protrusive resin catching portion and the inner periphery of said chip installation hole is greater than or equal to 0.05 mm and less than or equal to 0.5 mm, and preferably greater than or equal to 0.1 mm and less than or equal to 0.3 mm.

13. A liquid ejection head cartridge as claimed in claim 11, wherein the width of said chip installation hole along the aligning direction of said plurality of lead terminals other than said connecting portion is greater than or equal to 0.7 mm and less than or equal to 2.0 mm, and more preferably to be greater than or equal to 0.8 mm and less than or equal to 1.5 mm.

14. A liquid ejection head cartridge as claimed in any one of claims 9 to 11, wherein said liquid is at least one of an ink and a treatment liquid for adjusting a property of the ink ejected to said printing medium.

15. A liquid ejection head cartridge as claimed in any one of claims 9 to 11, wherein said ejection openings are arranged in opposition to said ejection energy generating means.

16. A liquid ejection head cartridge as claimed in any one of claims 9 to 11, wherein said sealing material is a solventless epoxy resin.

17. A printing apparatus for recording on a printing medium, comprising:

a mounting portion of a liquid ejection head including a head chip having a plurality of ejection openings, ejection energy generating means for ejecting a liquid from said ejection openings, and a liquid chamber communicated with said ejection openings and being supplied with a liquid, an electrical wiring substrate formed with a chip installation hole, being disposed in said chip installation hole said head chip, a plurality of lead terminals projecting into said chip installation hole of said electrical wiring substrate and being connected to said head chip for supplying electric power to said ejection energy generating means, and a sealing material layer sealing a connecting portion between said lead terminals and said head chip; and a protrusive resin catching portion for catching said sealing material, said protrusive resin catching portion being provided in a gap between said chip installation hole and said head chip.

18. A printing apparatus as claimed in claim 17, wherein said protrusive resin catching portion is a dummy lead terminal formed on said electric wiring substrate.

19. A printing apparatus as claimed in claim 17, wherein said protrusive resin catching portion is formed by having a width of said chip installation hole along the aligning direction of said plurality of lead terminals in said connecting portion be narrower than a width of an other portion.

20. A printing apparatus as claimed in any one of claims 17 to 19, wherein a width of a gap between said protrusive resin catching portion and said lead terminal closest to said protrusive resin catching portion, or a width of a gap between said protrusive resin catching portion and the inner periphery of said chip installation hole is greater than or equal to 0.05 mm and less than or equal to 0.5 mm, and preferably greater than or equal to 0.1 mm and less than or equal to 0.3 mm.

21. A printing apparatus as claimed in claim 19, wherein the width of said chip installation hole along the aligning direction of said plurality of lead terminals other than said connecting portion is greater than or equal to 0.7 mm and less than or equal to 2.0 mm, and more preferably to be greater than or equal to 0.8 mm and less than or equal to 1.5 mm.

22. A printing apparatus as claimed in any one of claims 17 to 19, wherein said liquid is at least one of an ink and a treatment liquid for adjusting a property of the ink ejected to said printing medium.

23. A printing apparatus as claimed in any one of claims 17 to 19, wherein said sealing material is a solventless epoxy resin.

24. A printing apparatus as claimed in any one of claims 17 to 19, wherein said mounting portion of said liquid ejection head is a carriage movable for scanning in a direction perpendicular to a transporting direction of said printing medium which a liquid droplet is ejected from said liquid ejection head.

25. A printing apparatus as claimed in claim 24, wherein said liquid ejection head is detachable from said carriage.

26. A printing apparatus as claimed in any one of claims 17 to 19, wherein said ejection openings of said liquid ejection head are arranged over the entire width of the printing region of said printing medium.

27. A printing apparatus as claimed in any one of claims 17 to 19, wherein the printing medium is selected from the group consisting of paper, cloth, plastic, metal, wood and leather.

28. A printing apparatus as claimed in any one of claims 17 to 19, wherein a plurality of colors of liquids are ejected from said liquid ejection head to perform color printing by depositing a plurality of colors of liquids on said printing medium.

29. A printing system comprising:

a control portion for processing an input image information; and output means for outputting information processed by said control portion, said output means including a printing apparatus as in any one of claims 17 to 19.

30. A fabrication process of a liquid ejection head comprising:

step of positioning a head chip having a plurality of ejection openings, ejection energy generating means for respectively ejecting a liquid through said ejection openings, and a liquid chamber communicated with said ejection openings and being supplied the liquid, in a chip installation hole formed in an electrical wiring substrate;

step of connecting a plurality of lead terminals projecting into said chip installation hole of said electrical wiring substrate from the inner periphery thereof for supplying electrical power to said ejection energy generating means;

step of applying a seal resin for sealing a connecting portion between said lead terminals and said head chip; and step of forming a protrusive resin catching portion for catching said seal resin within a gap portion between said chip installation hole and said head chip.

31. A fabrication process of a liquid ejection head as claimed in claim 30, wherein said protrusive resin catching portion is a dummy lead terminal formed on said electric wiring substrate.

32. A fabrication process of a liquid ejection head as claimed in claim 30, wherein said protrusive resin catching portion is formed by having a width of said chip installation hole along the aligning direction of said plurality of lead terminals in said connecting portion be narrower than a width of an other portion.

33. A fabrication process of a liquid ejection head as claimed in any one of claims 30 to 32, wherein a width of a gap between said protrusive resin catching portion and said lead terminal closest to said protrusive resin catching portion, or a width of a gap between said protrusive resin catching portion and the inner periphery of said chip installation hole is greater than or equal to 0.05 mm and less than or equal to 0.5 mm, and preferably greater than or equal to 0.1 mm and less than or equal to 0.3 mm.

34. A fabrication process of a liquid ejection head as claimed in claim 32, wherein the width of said chip installation hole along the aligning direction of said plurality of lead terminals other than said connecting portion is greater than or equal to 0.7 mm and less than or equal to 2.0 mm, and more preferably to be greater than or equal to 0.8 mm and less than or equal to 1.5 mm.

35. A fabrication process of a liquid ejection opening as claimed in any one of claims 30 to 32, wherein said sealing material is a solventless epoxy resin.

* * * * *

UNITED STATES PATENT AND TRADEMARK OFFICE

CERTIFICATE OF CORRECTION

PATENT NO. : 6,084,612
DATED : July 4, 2000
INVENTOR(S) : Takumi Suzuki, et al.

It is certified that error appears in the above-identified patent and that said Letters Patent is hereby corrected as shown below:

Title page,
[57] Abstract
Line 5, "supplied" should read --supplied with --; and
Line 6, "wherein" should read -- within --.

Column 1,
Line 30, "corresponded" should read -- corresponding --;
Line 41, "method" should read -- methods --;
Line 43, "requires" should read --require --.
Line 46, "number" should read --amount--; and
Line 50, "the" should read -- this --.

Column 2,
Line 31, "should form" should be deleted.

Column 3,
Line 2, "supplied" should read -- supplied with --;
Line 4, "wherein" should read -- within --;
Line 19, "a" (second occurrence) should be deleted; and
Line 31, "wherein" should read -- within --.

Column 5,
Line 52, "a" should read -- an --; and
Line 54, "respective" should read -- perspective --.

Column 8,
Line 15, "terminals" should read -- terminal --.

UNITED STATES PATENT AND TRADEMARK OFFICE

CERTIFICATE OF CORRECTION

PATENT NO. : 6,084,612
DATED : July 4, 200
INVENTOR(S) : Takumi Suzuki, et al.

It is certified that error appears in the above-identified patent and that said Letters Patent is hereby corrected as shown below:

Column 11,
Line 4, "the" (first occurrence) should be deleted; and "the" (third occurrence) should be deleted.

Column 9,
Line 1, "internal" should read -- interval --;
Line 6, "terminals" should read -- terminal --;
Line 7, "legs" should read -- less --;
Line 17, "plurality" should read -- plurality of --; and
Line 39, "corresponds" should read -- corresponds to --.

Column 10,
Line 3, "opposes with" should read -- oppose --.
Line 29, "the" (second occurrence) should be deleted; and
Line 32, "of" should be deleted.

UNITED STATES PATENT AND TRADEMARK OFFICE

CERTIFICATE OF CORRECTION

PATENT NO. : 6,084,612
DATED : July 4, 2000
INVENTOR(S) : Takumi Suzuki, et al.

It is certified that error appears in the above-identified patent and that said Letters Patent is hereby corrected as shown below:

Column 13,
Line 54, "an other" should read -- another --.

Column 14,
Line 10, "a" should be deleted; and
Line 42, "an other" should read -- another --.

Column 15,
Line 12, "being" should read -- said head chip being --;
Line 13, "said head chip," should be deleted;
Line 31, "an other" should read -- another --; and
Line 59, "medium which" should read -- medium to which --.

Column 16,
Line 45, "an other" should read -- another --.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*